US005413339A

United States Patent [19]

Martin

[11] Patent Number: 5,413,339

[45] Date of Patent: May 9, 1995

[54] ROTATING GOLF CLUB HANDLE

[76] Inventor: Dennis J. Martin, 1859 Mississippi St., New Brighton, Minn. 55112

[21] Appl. No.: 205,084

[22] Filed: Mar. 3, 1994

[51] Int. Cl.[6] ..... A63B 53/14

[52] U.S. Cl. ..... 273/81 C

[58] Field of Search ..... 273/81 R, 81 C

[56] References Cited

U.S. PATENT DOCUMENTS

| | | | |
|---|---|---|---|
| 1,305,952 | 6/1919 | Suesman | 273/81 C |
| 1,544,226 | 6/1925 | De Bus | 273/81 C |
| 2,225,839 | 12/1940 | Moore, Jr. | 273/81 C |
| 3,203,697 | 8/1965 | Berzatzy | 273/75 |
| 3,804,413 | 4/1974 | Hrivnak | 273/81 C |
| 3,806,130 | 4/1974 | Jacques | 273/183 D |
| 3,834,714 | 9/1974 | Smolinski | 273/183 D |
| 4,365,807 | 12/1982 | Melby | 273/81 C |
| 4,826,168 | 5/1989 | McGuire et al. | 273/81.2 |

*Primary Examiner*—William H. Grieb

[57] ABSTRACT

A golf club handle shaft has mounted thereon a fixed golf club handle, with a handle sleeve mounted to the handle shaft in adjacency to the handle, such that the handle sleeve permits rotation of the lowermost hand during a golf swing.

10 Claims, 3 Drawing Sheets

ROTATING GOLF CLUB HANDLE

BACKGROUND OF THE INVENTION

1. Field of the Invention

The field of invention relates to golf club handle structure, and more particularly pertains to a new rotating golf club handle wherein the same is arranged for rotation relative to a golf club shaft during a golf swing.

2. Description of the Prior Art

Golf club handle structure of various types have been employed in the prior art and exemplified by the U.S. Pat. Nos. 4,826,168; 3,834,714; 4,365,807; and 3,806,130.

The instant invention attempts to overcome deficiencies of the prior art by providing for a golf club handle having a first fixed handle portion positioned in adjacency relative to a second rotatable handle portion and in this respect, the present invention substantially fulfills this need wherein the lowermost handle during a golf swing is permitted to rotate during the swing, thereby preventing the golfer from "slicing" or "hooking" the golf ball.

SUMMARY OF THE INVENTION

In view of the foregoing disadvantages inherent in the known types of golf club handle structure now present in the prior art, the present invention provides a rotating golf club handle wherein the same is arranged to permit the rotation of an individual's lowermost hand during a golf swing.

To attain this, the present invention provides a golf club handle shaft mounted thereon a fixed golf club handle, with a handle sleeve mounted to the handle shaft in adjacency to the handle, such that the handle sleeve permits rotation of the lowermost hand during a golf swing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is an object of the present invention to provide a new rotating golf club handle which may be easily and efficiently manufactured and marketed.

It is a further object of the present invention to provide a new rotating golf club handle which is of a durable and reliable construction.

An even further object of the present invention is to provide a new rotating golf club handle which is susceptible of a low cost of manufacture with regard to both materials and labor, and which accordingly is then susceptible of low prices of sale to the consuming public, thereby making such rotating golf club handles economically available to the buying public.

Still yet another object of the present invention is to provide a new rotating golf club handle which provides in the apparatuses and methods of the prior art some of the advantages thereof, while simultaneously overcoming some of the disadvantages normally associated therewith.

Even still yet another object of the present invention is to provide a new rotating golf club handle for use with a golf club handle shaft having a fixed golf club handle mounted thereon, in which a handle sleeve is mounted to the handle shaft in adjacency to the handle, such that the handle sleeve permits rotation of the lowermost hand during a golf swing.

These together with other objects of the invention, along with the various features of novelty which characterize the invention, are pointed out with particularity in the claims annexed to and forming this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
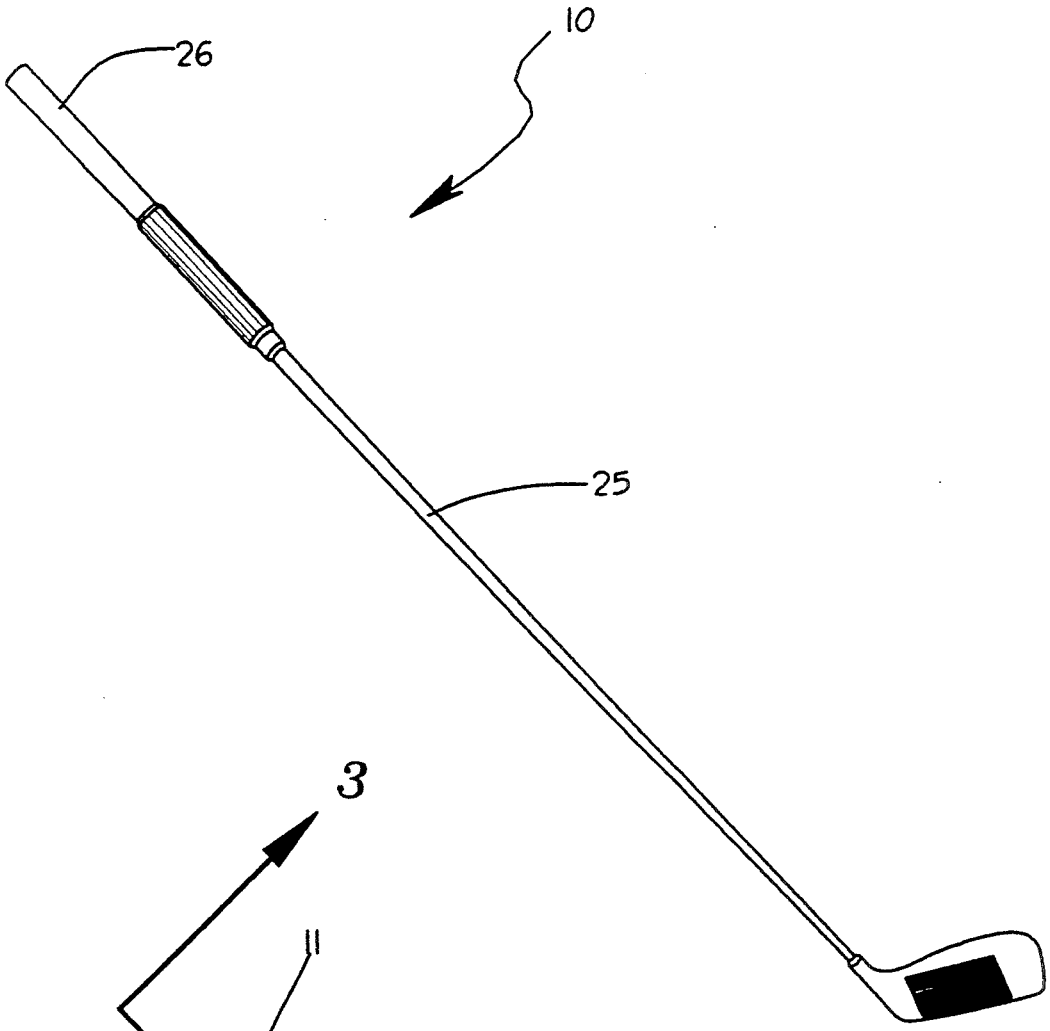
FIG. 1 is an isometric illustration of the invention mounted to a golf club structure.

With reference now to the drawings, and in particular to FIGS. 1–6 thereof, a new rotating golf club handle embodying the principles and concepts of the present invention and generally designated by the reference numeral 10 will be described.

Figure 2:
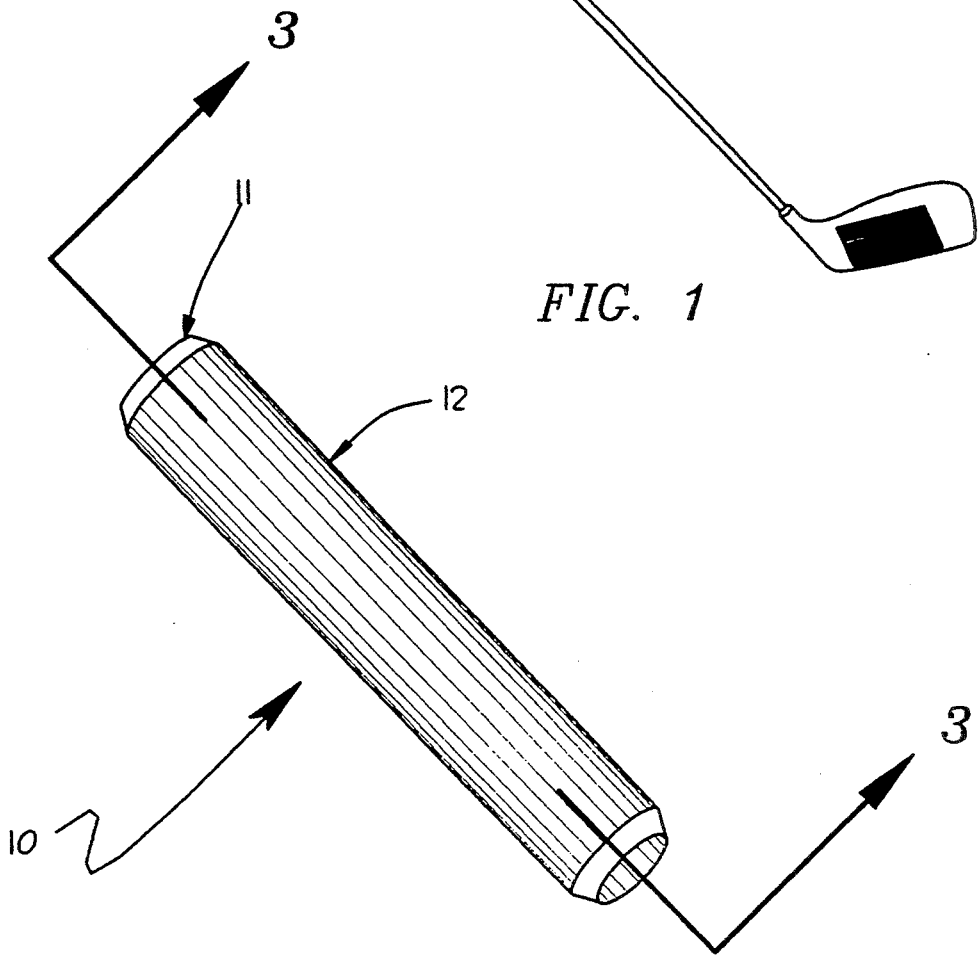
FIG. 2 is an isometric illustration of the golf club sleeve structure.

More specifically, the rotating golf club handle construction 10 of the instant invention comprises a golf club handle shaft 25, such as illustrated in FIG. 1, having a fixed handle portion 26 mounted to the handle shaft extending to the handle shaft free distal end spaced from the golf club head. A lowermost handle member is provided, as indicated in FIG. 2, and mounted to the golf club handle shaft 25 in concentric adjacency to the fixed handle 26. The lower handle, as illustrated in FIG. 3, includes an inner sleeve 11 fixedly secured to the handle portion 26 with an outer sleeve 12 concentrically and rotatably mounted about the inner sleeve 11.

Figure 3:
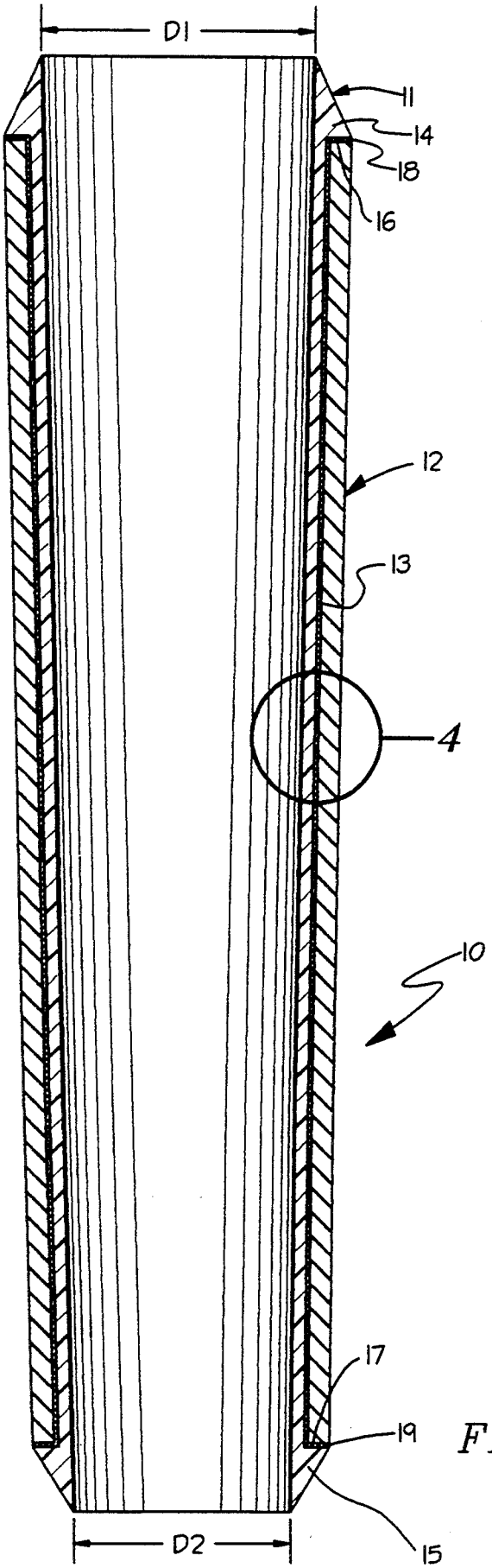
FIG. 3 is an orthographic view, taken along the lines 3—3 of FIG. 2 in the direction indicated by the arrows.
Figure 4:
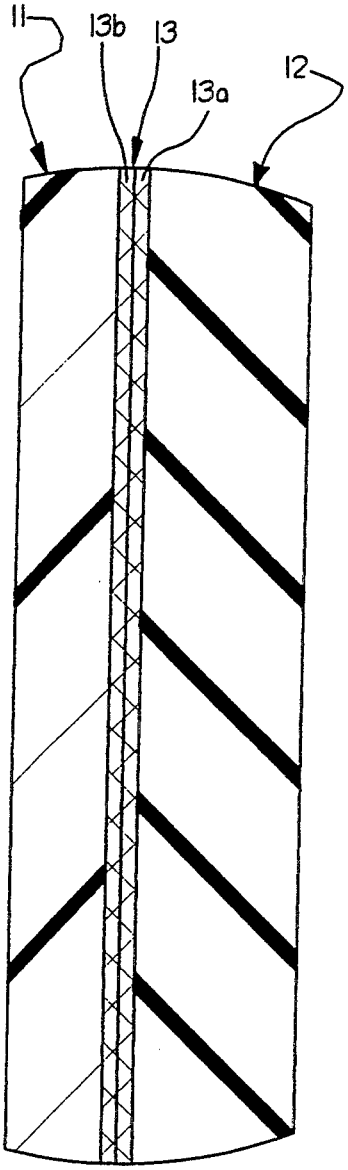
FIG. 4 is an enlarged orthographic view of section 4, as set forth in FIG. 3.
Figure 5:
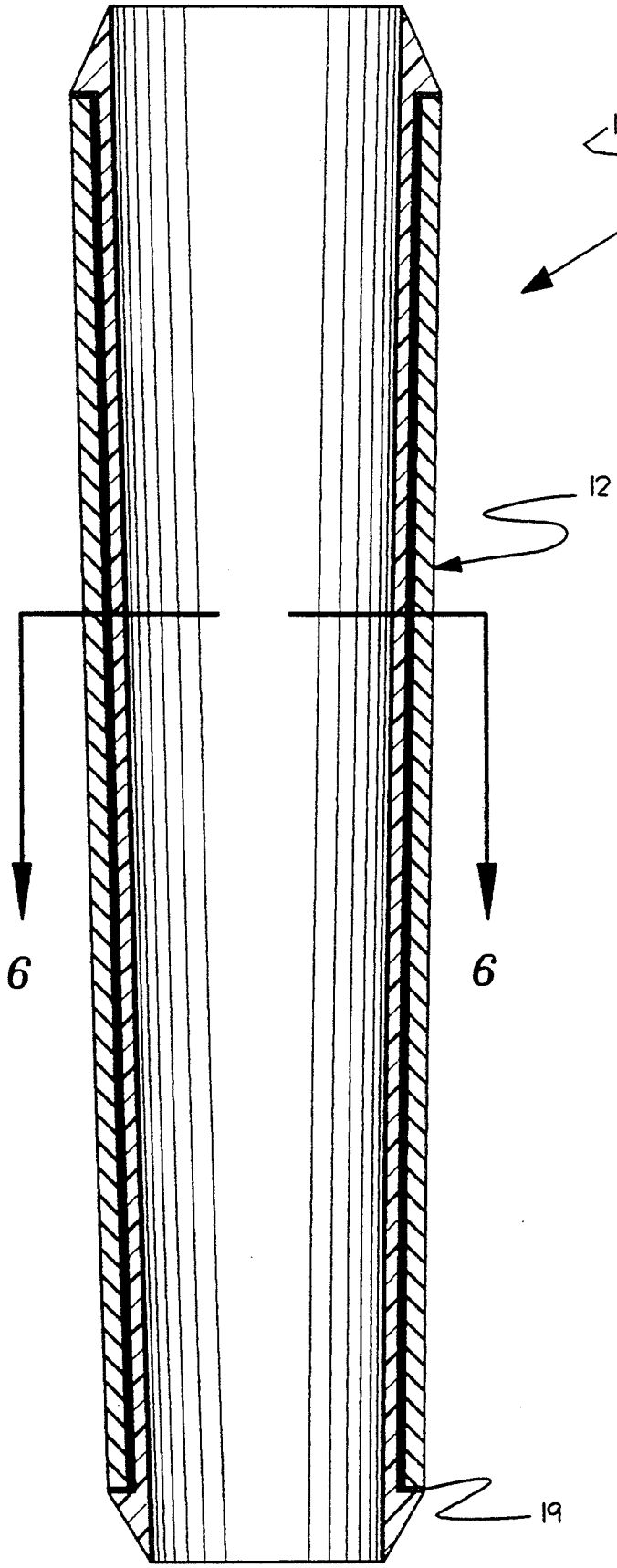
FIG. 5 is an orthographic, cross-sectional illustration of the inner and outer sleeve structure of the golf club lowermost handle, having roller bearing construction.
Figure 6:
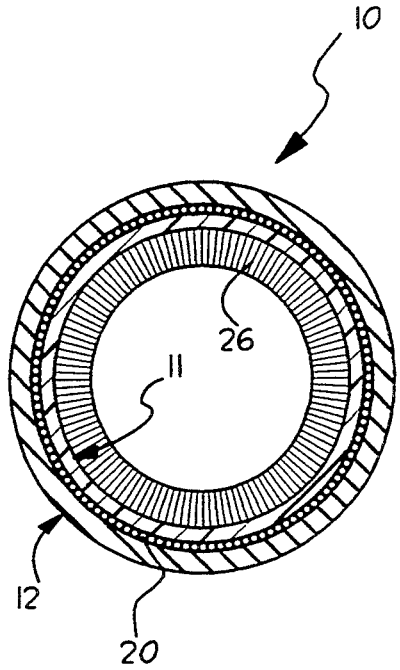
FIG. 6 is an orthographic view, taken along the lines 6—6 of FIG. 5 in the direction indicated by the arrows.

As best illustrated in FIG. 3, the inner sleeve 11 is tapered along a longitudinal length thereof. Specifically, the inner sleeve 11 has a first diameter D1 at the uppermost end thereof and a second diameter D2 at the lowermost end thereof. Typically, most conventional golf club handles are tapered from a larger diameter at an uppermost of the handle to a smaller diameter at a lowermost end of the handle. Therefore, the inner sleeve 11 of the present invention should be constructed such that the uppermost diameter D1 is at least slightly greater than the lowermost diameter D2. To install the device 10 onto a golf club handle, it is desirable to first remove the handle 26, place the invention 10 concentrically over the shaft, replace the handle, and slide the device over the handle, whereby snug frictional engagement will retain the device thereover.

To facilitate ease of relative rotation between the inner and outer sleeves 11, 12, the inner and outer sleeves, at their interface, include a bearing sleeve assembly 13, preferably formed of TEFLON (R) material. The bearing sleeve assembly 13 includes an outer bearing sleeve **13*a* mounted to the outer sleeve 12, and an inner bearing sleeve 13*b* mounted to the inner sleeve 11. To this end, the relative rotation of the inner and outer bearing sleeves relative to one another produce considerably less friction than a mere single bearing sleeve interposed between the inner and outer sleeve structures 11 and 12. To preclude axial movement of the outer sleeve 12 relative to the inner sleeve 11, the inner sleeve includes an upper annular flange 14 and a lower annular flange 15 at respective upper and lower distal ends of the inner sleeve. The upper annular flange 14 defines an upper sleeve annular wall 16 arranged in a facing parallel relationship relative to a lower sleeve annular wall 17 defined by the lower annular flange 15, with first bearings 18 interposed between the upper wall 16 and the uppermost end of the outer sleeve 12, and second bearings 19 interposed between the lower wall 17 and the lowermost end of the outer sleeve. The FIGS. 5 and 6 indicate that in lieu of the beating assembly 13, elongate roller bearings 20 may be interposed between the inner and outer sleeves 11 and 12**.

In use, a golfer secures the fixed handle 25 with an uppermost hand, and the lowermost hand is mounted about the device 10, thereby eliminating the unintentional use of the lowermost hand in controlling golf club rotation during the swing and therefore minimize the tenancy to "hook" or "slice" the golf ball during a golf swing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rotating golf club handle for use with a golf club including an elongate golf club handle shaft having a shaft first end and a shaft second end with a golf club head secured to said first end, and a fixed handle positioned about said second end along said fixed handle, said rotating golf club handle comprising: an inner sleeve concentrically positionable over and frictionally engagable to the fixed handle, whereby said inner sleeve is selectively removable from said fixed handle as desired when engaged thereto, and an outer sleeve rotatably mounted concentrically about the inner sleeve.

2. A rotating golf club handle as set forth in claim 1, wherein the inner sleeve includes an inner sleeve first end and an inner sleeve second end, the inner sleeve first end including an upper annular flange, and the inner sleeve second end including a lower annular flange, the upper annular flange having an upper annular wall, the lower annular flange having a lower annular wall arranged in a facing parallel relationship relative to the upper annular wall, with first bearings interposed between the upper annular wall and the outer sleeve, and second bearings interposed between the lower annular wall and the outer sleeve.

3. A rotating golf club handle as set forth in claim 2, wherein the inner sleeve first end is of a first diameter and the inner sleeve second end is of a second diameter, with said first diameter being at least slightly greater than said second diameter such that the rotating golf club handle may be frictionally engaged to said fixed handle.

4. A rotating golf club handle as set forth in claim 3, wherein the outer sleeve includes outer bearing sleeve, and the inner sleeve includes an inner bearing sleeve, with the outer bearing sleeve and the inner bearing sleeve arranged in concentric relationship relative to one another in a coextensive relationship extending between the upper annular wall and the lower annular wall, with the outer bearing sleeve and the inner bearing sleeve arranged for relative rotation relative to one another.

5. A rotating golf club handle as set forth in claim 3, and further comprising a plurality of elongated roller bearing interposed between the outer sleeve and the inner sleeve.

6. A rotating golf club handle comprising for use with a golf club including an elongate golf club handle shaft having a shaft first end and a shaft second end with a golf club head secured to said first end, said rotating golf club handle comprising:

a fixed handle positionable about said second end along said fixed handle;

an inner sleeve concentrically positioned over and frictionally engaged to the fixed handle; and, an outer sleeve rotatably mounted concentrically about the inner sleeve.

7. A rotating golf club handle as set forth in claim 6, wherein the inner sleeve includes an inner sleeve first end and an inner sleeve second end, the inner sleeve first end including an upper annular flange, and the inner sleeve second end including a lower annular flange, the upper annular flange having an upper annular wall, the lower annular flange having a lower annular wall arranged in a facing parallel relationship relative to the upper annular wall, with first bearings interposed between the upper annular wall and the outer sleeve, and second bearings interposed between the lower annular wall and the outer sleeve.

8. A rotating golf club handle as set forth in claim 7, wherein the inner sleeve first end is of a first diameter and the inner sleeve second end is of a second diameter, with said first diameter being at least slightly greater than said second diameter such that the rotating golf club handle may be frictionally engaged to said fixed handle.

9. A rotating golf club handle as set forth in claim 8, wherein the outer sleeve includes an outer bearing sleeve, and the inner sleeve includes an inner bearing sleeve, with the outer bearing sleeve and the inner bearing sleeve arranged in concentric relationship relative to one another in a coextensive relationship extending between the upper annular wall and the lower annular wall, with the outer bearing sleeve and the inner bearing sleeve arranged for relative rotation relative to one another.

10. A rotating golf club handle comprising for use with a golf club including an elongate golf club handle shaft having a shaft first end and a shaft second end with a golf club head secured to said first end, said rotating golf club handle comprising:

a fixed handle positionable about said second end along said fixed handle, said fixed handle being substantially tapered along a longitudinal length thereof;

an inner sleeve concentrically positioned over and frictionally engaged to the fixed handle; and, an outer sleeve rotatably mounted concentrically about the inner sleeve, wherein the inner sleeve includes a first end of a first diameter, the inner sleeve further including a second end of a second diameter, with said first diameter being at least slightly greater than said second diameter.

* * * * *